United States Patent [19]

Allenbaugh

[11] 4,248,452

[45] Feb. 3, 1981

[54] LOCK WITH IMPROVED PROVISIONS FOR WITHSTANDING FORCES APPLIED TO BOLT

[75] Inventor: Howard M. Allenbaugh, Fountain Valley, Calif.

[73] Assignee: M.A.G. Engineering Co., Gardena, Calif.

[21] Appl. No.: 923,912

[22] Filed: Jul. 12, 1978

[51] Int. Cl.[3] ..... E05C 1/16

[52] U.S. Cl. ..... 292/167

[58] Field of Search ..... 292/167, 153, 169, 150, 292/337, 169; 70/417

[56] References Cited

U.S. PATENT DOCUMENTS

| | | | |
|---|---|---|---|
| 2,015,248 | 9/1935 | Williams | 70/417 X |
| 2,307,038 | 1/1943 | Gutman | 292/167 |
| 2,676,827 | 4/1954 | Schlage | 292/167 X |
| 3,036,850 | 5/1962 | Schmid | 292/167 X |

*Primary Examiner*—Richard E. Moore

*Attorney, Agent, or Firm*—Fulwider, Patton, Rieber, Lee & Utecht

[57] ABSTRACT

A door lock including a bolt connected by a link to an actuator mechanism by which it is movable within a housing between a retracted position and an extended position. A pin and slot connection between the bolt and link form a coaction mechanism that causes a prong on the link to engage an abutment on the housing when a force is applied to the extended bolt in the direction of its retracted position. As the link pivots, a second abutment on the housing is engaged to further resist bolt movement. The force is then absorbed by the housing rather than the more fragile actuator mechanism. If the bolt is subjected to a force that would tend to pull it from the lock, the link engages another abutment on the housing to retain the bolt.

The bolt is movable a short distance from its normal extended position by compressing a spring without transmitting to the link the force applied to the bolt. A hardened security pin within the bolt normally transmits the spring force to the link to avoid looseness.

16 Claims, 6 Drawing Figures

LOCK WITH IMPROVED PROVISIONS FOR WITHSTANDING FORCES APPLIED TO BOLT

FIELD OF THE INVENTION

The present invention is related to locks, and, more particularly, to door locks that may be subjected to attack by a force applied directly to the bolt.

BACKGROUND OF THE INVENTION

Thieves and other unauthorized entrants most often attempt to disable a door lock by various simple techniques that require little time. Rather than attempting to retract the lock bolt by actuating the lock mechanism, they sometimes resort to a direct attack on the bolt itself. This technique is most frequently employed where the construction of the door frame and walls surrounding the lock is such that the extended bolt is relatively accessible.

One such technique calls for punching a hole in the wall adjacent the swingable edge of the door so that a thin metal rod inserted through the hole rests against the outer end of the bolt. A sharp hammer blow is then applied to the rod, driving the bolt back into the lock mechanism. Many otherwise secure locks can be defeated with relative ease in this manner because the entire force of the blow must be absorbed by the actuator mechanism and the linkage by which that mechanism is connected to the bolt. Space limitations and the complexity of the mechanism often dictate that it must have considerably less strength than the bolt itself and it is often found that the pin by which the inner end of a bolt link is attached to the actuator mechanism can be sheared off by a relatively small force, allowing the bolt to be completely retracted into the door.

Another technique for attacking the bolt directly is to force a chisel between the door and the frame so that it contacts the bolt at a slight angle. A hammer blow is then applied to the chisel to drive the bolt back against the lock mechanism with the same result described above. This method of attack is most often used with an outwardly opening door where there is no overlap between the edge of the door and the frame and the bolt is, therefore, readily accessible. It should be noted that in many locks the bolt need be driven only a very short distance into the lock before one of the lock components fails and the bolt can slide freely into its retracted position.

In the case of an inwardly opening door, perhaps the simplest technique for defeating a lock is a powerful shoulder blow or kick to the door itself. It is sometimes found that when this technique is used, the bolt binds within a socket in the door frame and, as the door tends to open, the bolt is pulled away from the lock. Although the bolt may be capable of withstanding large purely transverse forces, the actuator mechanism sometimes fails under these circumstances in such a way that the bolt is completely removed from the lock and remains with the frame as the door swings open.

In an effort to combat lock failures of the type described above, many lock manufacturers have been forced to employ relatively heavy and expensive actuator mechanisms. They have generally avoided the use of plastics and other lighter, less expensive materials that would be suitable for producing the desired bolt movement when the lock is operated, but could not withstand forces that would tend to push the bolt into the lock or pull the bolt out of the lock.

A principal objective of the present invention is to provide a door lock which utilizes a relatively simple actuator mechanism and can incorporate plastic or other lightweight components but is nevertheless relatively immune to attack by forces applied to the bolt.

SUMMARY OF THE INVENTION

The present invention resides in a door lock in which forces applied to the bolt are not transmitted to the actuator mechanism that moves the bolt between its retracted and extended positions. It is, therefore, possible to use a light, smooth operating and inexpensive actuating mechanism in a lock that is relatively immune to attack by forces applied to the bolt.

According to one aspect of the invention, the lock includes a bolt that is movable between an extended position and a retracted position in a door mounted housing. An actuator mechanism, which may be of the mortise cylinder type or any of the variety of other such known mechanisms, is connected to the bolt by a link to cause movement of the bolt when the lock is operated. The bolt housing is a relatively rugged component secured to the door independently of the actuator mechanism and includes an abutment that is engageable by the link. Upon the application to the bolt of a force directed toward its retracted position, the link contacts the abutment so that the force is applied to the housing and is not transmitted to the actuator mechanism.

Movement of the link to engage the abutment is caused by a coaction mechanism that can be in the form of a pin and slot connection permitting both pivoting and sliding movement between the link and the bolt. The slot is inclined with respect to the extending and retracting motion of the bolt so that an inward force applied from the bolt to the link causes a prong carried by the link to be lifted into an opening in the housing as the link pivots on the pin. For added strength, another portion of the link may contact a second abutment on the housing on the opposite side of the pin to further restrain the resulting pivotal movement of the link.

According to another aspect of the invention, the link carries a ramp surface that engages a portion of the bolt housing when an outwardly directed force is applied to the bolt that would tend to pull the bolt out of the housing beyond its extended position. Simultaneously, the prong engages an abutment at the opposite end of the opening and the link becomes wedged within the housing to retain the bolt.

Still another aspect of the invention resides in the use of a spring disposed within the bolt to urge the bolt toward its extended position. The spring permits limited resilient movement of the bolt toward its retracted position. In the event that the bolt is driven back a short distance into the lock, the spring permits the bolt to move without transmitting the force to the actuating mechanism.

Preferably, a hardened security pin is disposed within a bore in the bolt so that the spring urges the pin against the link. The pin, which is freely rotatable within the bolt, prevents the bolt from being sawed, since the teeth of the saw would simply turn the pin rather than bite into it. In addition to permitting limited movement of the bolt to prevent efforts to disable the lock, the spring, when used in combination with the coaction mechanism described above, prevents looseness of the bolt that would otherwise result from the pin and slot connection described above.

Other features and advantages of the present invention will become apparent from the following detailed description, taken in conjunction with the accompanying drawings, which illustrate, by way of example, the principles of the invention.

DETAILED DESCRIPTION OF THE PREFERRED EMBODIMENT

Figure 1:
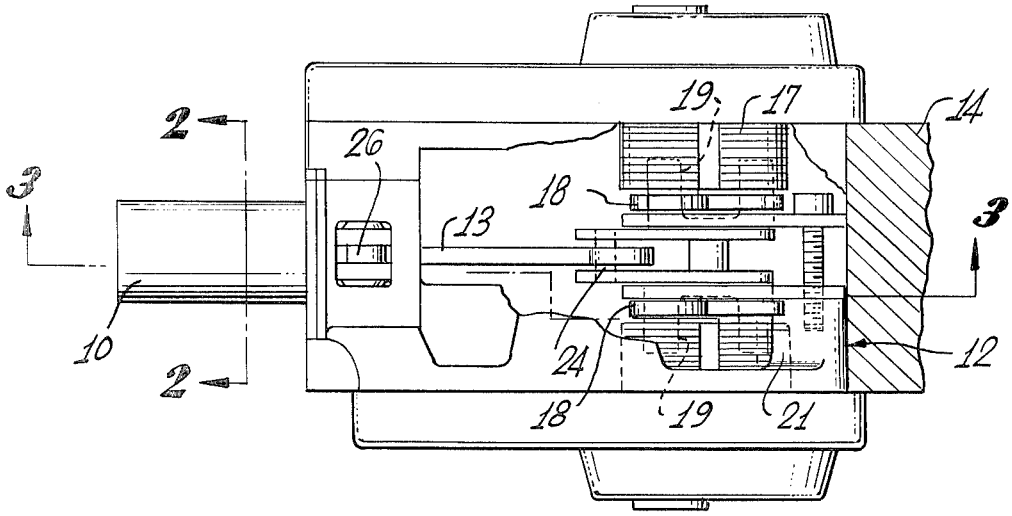
FIG. 1 is a partially broken away top view of an exemplary door lock constructed in accordance with the present invention, the bolt being shown in its extended position.
Figure 2:
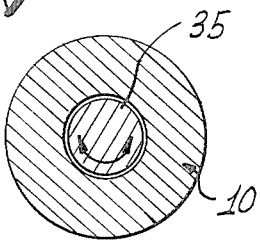
FIG. 2 is a cross-sectional view of the bolt taken along the line 2—2 of FIG. 1.
Figure 6:
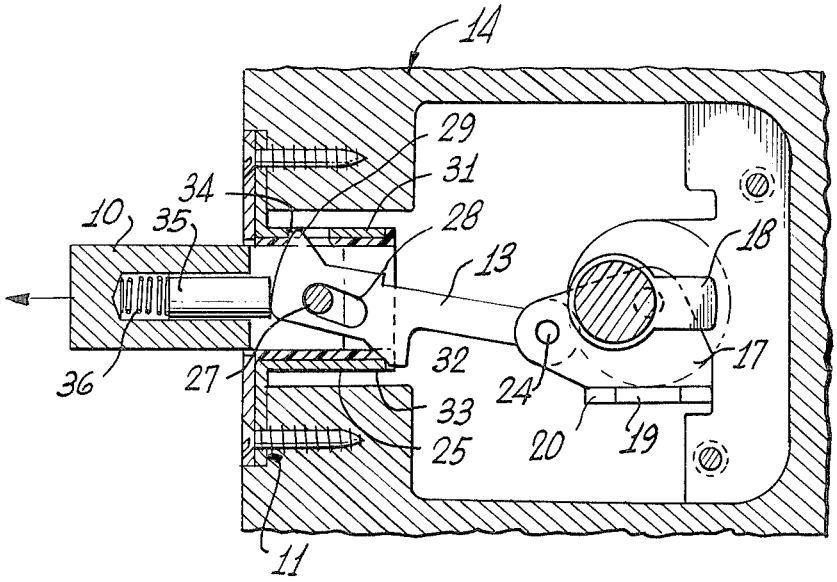
FIG. 6 is a cross-sectional view of the bolt extended and subject to an outwardly directed force.
Figure 3:
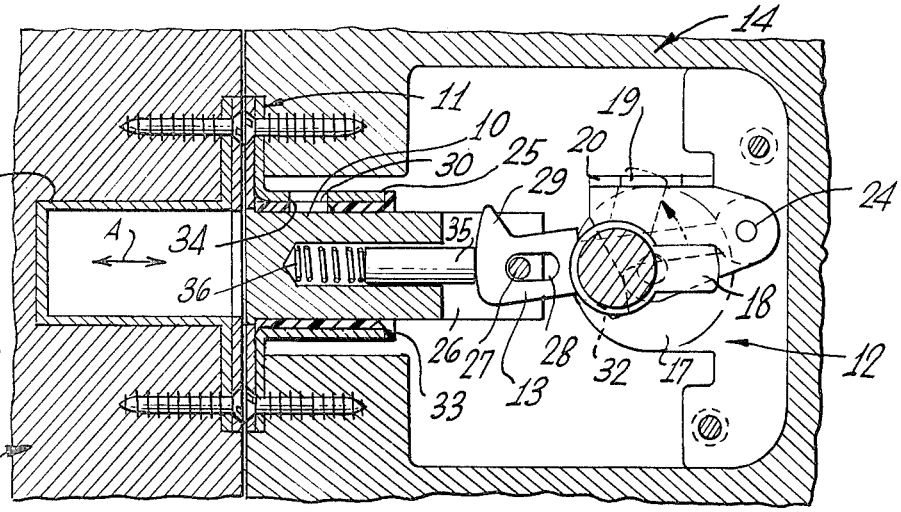
FIG. 3 is a cross-sectional view, taken along the line 3—3 of FIG. 1, illustrating the lock with the bolt in its retracted position.
Figure 4:
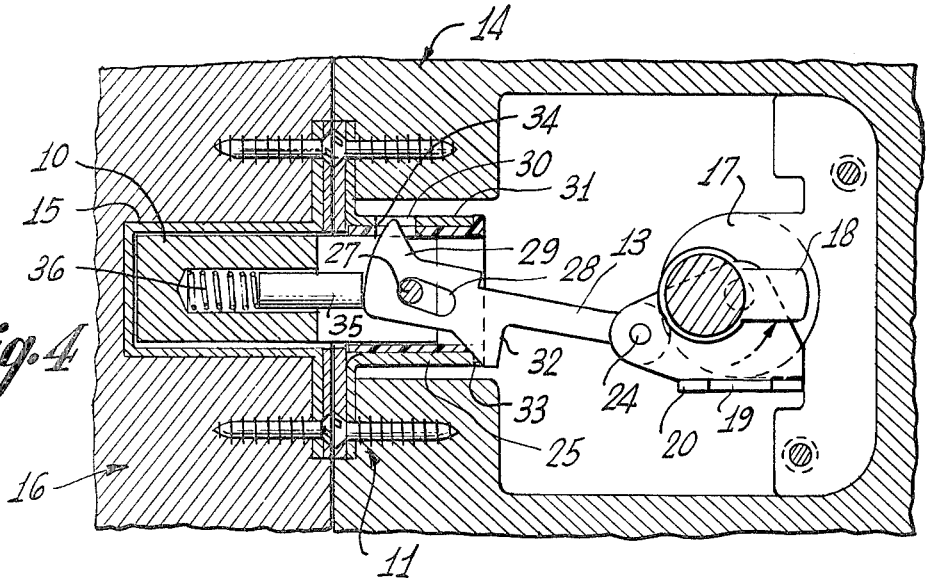
FIG. 4 is a similar cross-sectional view of the lock with the bolt in its extended position.

An exemplary door lock of the dead-bolt type, illustrated in FIGS. 1 through 6 of the accompanying drawings, embodies the novel aspects of the present invention. In general, it comprises a bolt 10 that is slidable within a door-mounted bolt housing 11 and operated by an actuator mechanism 12 to which it is connected by an elongated bolt link 13. The bolt can be moved between a retracted position within the door 14, as shown in FIG. 3, and an extended position in which it is received by a socket 15 in the door frame 16, as shown in FIGS. 1 and 4.

This exemplary form of the invention utilizes a mortise cylinder 17, of conventional construction, connected to the link 13 in the manner described in greater detail in U.S. Pat. No. 3,948,066. On the inner end of the cylinder is an eccentric cam 18 which can be rotated, by a key or thumb turn, for example, to engage a slot 19 in a connecting member 20 that is pivotably connected to the inner end of the link. As the cam enters the slot (as shown in phantom lines in FIG. 3), it causes rotation of the connecting member to push the link outwardly or pull it inwardly, thereby moving the bolt 10 to its extended or retracted position, depending upon the direction of rotation.

Figure 5:
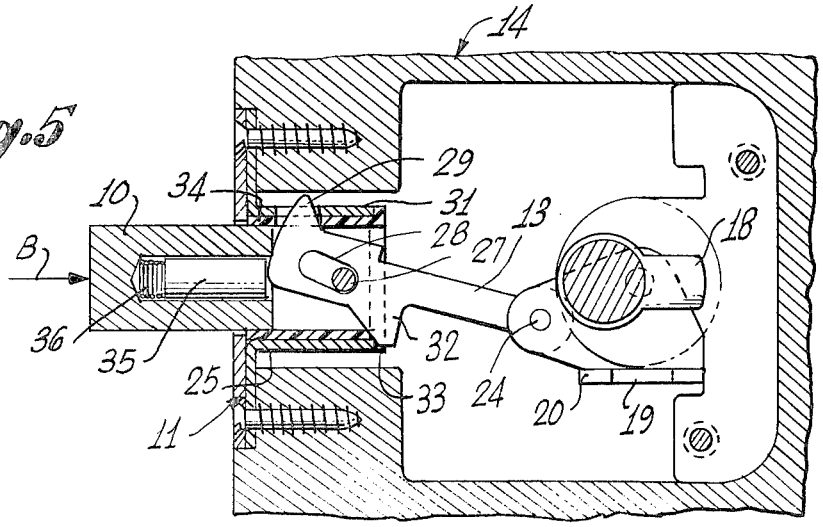
FIG. 5 is a cross-sectional view of the lock with the bolt extended and subject to an inwardly directed force.

The bolt 10 is cylindrical (as shown in FIG. 2) and is slidably received in a plastic lined, horizontal sleeve 25 that is part of the housing 11 and firmly secured to the swingable edge of the door 14. The inner end of the bolt is bifurcated by a vertical indentation 26 in which the outer end of the link 13 is loosely inserted. A horizontal cross pin 27 that is firmly anchored in the bolt extends transversely across the indentation through an elongated slot 28 in the link. This slot and pin connection forms a coaction mechanism that permits both sliding and pivoting movement of the link with respect to the bolt, the slot being inclined at an angle to the movement of bolt (indicated by the arrow A in FIG. 3) so that the outer end of the link is forced upwardly if the pin moves toward the inner end of the slot (as shown in FIG. 5).

A pointed upwardly projecting prong 29 is formed on the outer end of the link 13 and, when the bolt 10 is in its extended position (FIG. 4), this prong is aligned with and disposed immediately below an opening 30 in the top of the sleeve 25. If the link 13 is in this position, as it normally would be with the bolt extended and the door 14 locked, a force applied to the bolt and tending to drive it toward its retracted position (as indicated by the arrow B in FIG. 5) would push the pin 27 to the inner end of the slot 28, simultaneously lifting the link so that the prong enters the opening in the sleeve (as shown in FIG. 5). The inner end of the opening then serves an abutment 31 engaged by the prong to oppose the force applied to the bolt. Since the force is absorbed by the housing in this manner, it is not transmitted through the link to the actuator mechanism 12 in which it could otherwise cause a failure of the actuator pin 24 or another component, permitting the bolt to be freely retracted into the door.

To further strengthen the lock and resist inwardly directed forces applied to the bolt 10, the link 13 carries a downwardly projecting tab 32 which is disposed immediately behind the inner end of the sleeve 25 when the bolt is extended. A force applied to the link and causing the link to pivot on the actuator pin 24 as the cross pin 27 slides to the inner end of the slot 28, will cause the tab to engage the bottom inner end 33 of the sleeve, as shown in FIG. 5. A second abutment is thus provided whereby the housing resists the force applied to the bolt and prevents that force from being transmitted to the actuator mechanism 12. If the prong and tab do not engage their respective abutments simultaneously, the cross pin will flex slightly to allow engagement at both locations.

If a force sufficient to break the actuator pin 24 is applied to the extended bolt in the direction of movement from its retracted to its extended position, as might happen in the case of a blow that tends to open the door 14, the forward end of the tab 32 that forms an inclined ramp surface engages the aligned abutment 33 on the inner bottom end of the sleeve 25. Simultaneously, the prong 29 engages an abutment on the housing formed by the outer end 34 of the opening 30 so that the link becomes wedged to the sleeve. In this way, the force applied to the bolt is resisted by the housing 11 and is not transmitted to the actuator mechanism 12.

As a further protective measure, a cylindrical bore extends axially and horizontally within the bolt 10 and receives an axially slidable, freely rotatable, hardened steel, security pin 35 (shown in FIGS. 2–6) that engages the forward end of the link 13. In the outer end of the bore is a coil spring 36 which urges the pin inwardly against the link.

The spring 36 resiliently urges the bolt 10 outwardly so that the bolt is fully inserted in the socket 15 when in its extended position (FIG. 3), at the same time applying a small force against the link 13 to prevent looseness and undesired movement of the cross pin 27 within the slot 28. If a force is applied to the bolt in the direction of its retracted position, compression of the spring permits limited inward travel of the bolt without transmitting the force to the link or the actuator mechanism 12. Thus, if a would-be intruder were to insert a chisel between the frame 16 and the door 14 and attempt to drive the bolt back into the lock, the resilient movement of the bolt permitted by the spring would prevent damage to the actuator mechanism. It should be noted that the effect of repeated blows would not be cumulative since the bolt would spring back to its original fully extended position after each blow.

The security pin 35 is made of a harder material than the bolt 10 so that it resists any effort to saw the bolt with a blade (not shown) inserted between the door 14 and the fram 16. The fact that the pin is freely rotatable within the bolt prevents the teeth of the saw blade from biting.

It will be apparent from the foregoing that the lock of the present invention is capable of withstanding a variety of relatively large forces applied to the bolt 10 and does not transmit these forces to the more fragile actuator mechanism 12. Since it need not have force-absorbing strength, the actuator mechanism may be constructed with a view toward its sole and limited function of moving the bolt and may, in fact, make use of plastic parts.

While a particular embodiment of the invention has been illustrated and described, various modifications and changes can be made without departing from the spirit and scope of the invention.

I claim:

1. A door lock of the dead bolt type comprising:

a bolt;

a housing including a sleeve in which said bolt is movable between a retracted position and an extended position;

actuator means for causing movement of said bolt between said retracted position and said extended position, said actuator means including a mortise cylinder;

a link connecting said bolt to said actuator means;

an opening in said housing above said link;

a prong carried by said link;

coaction means for lifting said prong into said opening to prevent movement of said bolt upon the application of a force to said bolt directed toward said retracted position, said catch means comprising a pin and slot connection between said bolt and said link, said slot being inclined with respect to the movement of said bolt in said housing;

resilient means disposed within said bolt for urging said bolt away from said retracted position and toward said extended position; and means carried by said link and normally aligned with a portion of said housing for wedging said link within said housing to retain said bolt in said housing when a force is applied to said bolt in its direction of movement from said retracted position to said extended position.

2. A door lock comprising:

a bolt;

a housing in which said bolt is movable between a retracted position and an extended position;

actuating means for causing movement of said bolt between said extended and said retracted positions;

a link connecting said bolt to said actuator means;

a pair of abutments defined by said housing on opposite sides of said link; and coaction means for transmitting a force from said bolt to said link and for causing pivoting movement of said link and engagement of said link with said abutments to prevent movement of said bolt upon the application of a force to said bolt directed toward said unlocked position.

3. The door lock of claim 2 wherein said coaction means permits both sliding and pivoting movement between said bolt and said link.

4. The door lock of claim 3 wherein said coaction means comprises a pin and slot connection between said bolt and said link, said slot being inclined with respect to the movement of said bolt in said housing.

5. The door lock of claim 2 further comprising resilient means disposed within said bolt for urging said bolt away from said link and toward said extended position.

6. A lock for a door comprising:

a bolt;

a housing installed in said door in which said bolt is movable between a retracted position and an extended position;

actuator means for causing movement of said bolt between said retracted position and said extended position;

an abutment anchored to said door;

a link extending from said bolt toward said abutment; and connection means for pivotally and slidably connecting said bolt to said link, for limiting sliding movement of said bolt relative to said link and for causing said link to engage said abutment in response to a force applied to said bolt in the direction of said retracted position.

7. The door lock of claim 6 wherein said link includes an upwardly projecting prong, said prong being the portion of said link which is engageable with said abutment.

8. The door lock of claim 6 wherein said abutment is formed by an opening in said housing.

9. The door lock of claim 6 further comprising resilient means disposed within said bolt for urging said bolt away from said retracted position and toward said extended position.

10. The door lock of claim 6 further comprising:

a security pin disposed within said bolt and engageable with said link; and resilient means disposed within said bolt for urging said security pin toward said link, thereby permitting limited resilient movement of said bolt toward said retracted position.

11. The door lock of claim 6 further comprising means for causing said link to engage said housing to prevent removal of said bolt from said housing by a force urging said bolt in its direction of movement from said retracted position to said extended position.

12. The door lock of claim 6 further comprising:

an opening in said housing by which said abutment is defined;

a prong carried by said link that is insertable in said opening; and cam means carried by said link and normally aligned with a portion of said housing for causing insertion of said prong into said opening to retain said bolt in said housing when a force is applied moving said bolt in its direction of movement from said retracted position to said extended position.

13. A door lock comprising:

a bolt;

a housing in which said bolt is movable between an extended and a retracted position;

actuator means for causing movement of said bolt between said extended position and said retracted position;

a link connecting said bolt to said actuator means;

an abutment defined by said housing and engageable by said link; and means carried by said link for causing said link to become wedged in said housing when a force is applied to said bolt in its direction of motion from said retracted position to said extended position.

14. A door lock comprising:

a bolt;

a housing in which said bolt is movable between a retracted position and an extended position;

actuator means for causing movement of said bolt between said retracted position and said extended position;

a link connecting said bolt to said actuator means;

resilient means for urging said bolt toward said extended position but permitting limited resilient movement of said bolt toward said retracted position; and a security pin disposed within said bolt and engageable with said link, said resilient means urging said security pin toward said link.

15. The door lock of claim 14 wherein said security pin is freely rotatable within said bolt and is harder than said bolt.

16. A lock for a door comprising:

a bolt;

a housing installed in said door in which said bolt is movable between a retracted position and an extended position;

actuator means for causing movement of said bolt between said retracted position and said extended position;

an abutment anchored to said door;

a link extending from said bolt toward said abutment; and connection means for connecting said bolt to said link, said connection means comprising a slot that is inclined with respect to movement of said bolt from said extended position to said retracted position and a pin received by said slot.

* * * * *

UNITED STATES PATENT AND TRADEMARK OFFICE

CERTIFICATE OF CORRECTION

PATENT NO. : 4,248,452

DATED : February 3, 1981

INVENTOR(S) : Howard M. Allenbaugh

It is certified that error appears in the above-identified patent and that said Letters Patent are hereby corrected as shown below:

In the Claims:

Column 5, line 38 "catch" should be --coaction--.

Signed and Sealed this

*Twenty-eighth* Day of *April 1981*

[SEAL]

*Attest:*

RENE D. TEGTMEYER

*Attesting Officer*

*Acting Commissioner of Patents and Trademarks*